US010926152B2

(12) United States Patent
Tucker

(10) Patent No.: US 10,926,152 B2
(45) Date of Patent: Feb. 23, 2021

(54) STORAGE RACK AND CONVEYOR FOR SPORTS EQUIPMENT

(71) Applicant: Mak Pickleball, LLC, Dallas, OR (US)

(72) Inventor: Robert Tucker, Dallas, OR (US)

(73) Assignee: Mak Pickleball, LLC, Dallas, OR (US)

( * ) Notice: Subject to any disclaimer, the term of this patent is extended or adjusted under 35 U.S.C. 154(b) by 0 days.

(21) Appl. No.: 16/299,845

(22) Filed: Mar. 12, 2019

(65) Prior Publication Data

US 2020/0290810 A1 Sep. 17, 2020

(51) Int. Cl.

| | |
|---|---|
| ***A63B 71/00*** | (2006.01) |
| *A47F 7/00* | (2006.01) |
| *A47F 5/08* | (2006.01) |
| *A47F 5/00* | (2006.01) |

(52) U.S. Cl.

CPC ..... *A63B 71/0045* (2013.01); *A47F 5/00* (2013.01); *A47F 5/08* (2013.01); *A47F 7/0028* (2013.01)

(58) Field of Classification Search

CPC .. B65G 17/007; B65G 17/326; B65G 17/323; B65G 43/08; B65G 21/00; A47F 7/0028; A47F 5/08; A47F 5/00; A63B 71/0045

USPC ..... 211/1.51, 1.52, 1.53, 1.56, 1.57, 85.7, 211/121, 122; 198/470.1, 474.1, 867.02, 198/867.11, 867.12, 836.1; 273/317.4

See application file for complete search history.

(56) References Cited

U.S. PATENT DOCUMENTS 443,488 A * 12/1890 Clair ..... 198/821
553,109 A * 1/1896 Davison ..... A47F 3/08 211/121
739,275 A 9/1903 Abbe
815,228 A 3/1906 Stone
1,287,984 A * 12/1918 Haschek ..... 198/798
1,293,410 A 2/1919 Goodwin
2,032,094 A 2/1936 Le
2,616,776 A 11/1952 Jones
2,767,535 A * 10/1956 Bentley ..... B65B 27/10 53/586
2,980,258 A * 4/1961 Collette ..... B65G 17/20 211/1.56

(Continued)

FOREIGN PATENT DOCUMENTS

EP 2633785 9/2013
FR 2740046 4/1997

*Primary Examiner* — Jonathan Liu
*Assistant Examiner* — Devin K Barnett
(74) *Attorney, Agent, or Firm* — Klarquist Sparkman, LLP

(57) ABSTRACT

An assembly for conveying sports equipment includes a first pulley, a second pulley, and a belt extending between and movable around the pulleys. A plurality of engagement members are coupled to the belt such that they travel along a path extending from the first pulley to the second pulley and back. The second pulley is spaced apart from the first pulley along a first axis, and along a second axis that is perpendicular to the first axis such that the belt is inclined toward the second pulley, and such that sports equipment engaged with an engagement member beneath the first pulley will advance toward the second pulley. A stop member is offset from the path of the engagement members such that empty engagement members can proceed beyond the stop member, and the stop member is configured to stop motion of the belt upon contacting sports equipment conveyed by engagement members.

20 Claims, 9 Drawing Sheets

(56) References Cited

U.S. PATENT DOCUMENTS 3,064,823 A * 11/1962 Shock ..... A63B 67/04 211/15
3,224,558 A * 12/1965 Carlen ..... B65H 29/66 198/434
3,258,109 A * 6/1966 Brettenstein ..... G07F 11/58 198/801
3,633,736 A * 1/1972 Golden ..... B65G 47/50 211/122
3,858,725 A 1/1975 Pietrack et al.
3,955,267 A * 5/1976 deCaussin ..... B23Q 3/15546 483/10
4,154,442 A * 5/1979 Trubody ..... A63B 71/0045 473/415
4,193,495 A * 3/1980 Keeley ..... A63B 71/0045 294/143
4,293,062 A * 10/1981 Bustos ..... B65G 21/02 193/2 D
RE31,945 E * 7/1985 Magni ..... B23Q 7/03 198/341.07
4,821,887 A * 4/1989 Iemura ..... B65G 1/133 211/1.56
5,209,359 A * 5/1993 Arnold ..... A47F 5/08 211/106
5,311,976 A * 5/1994 Backman ..... B65G 17/323 198/349.1
5,314,078 A * 5/1994 Morikiyo ..... A47F 1/087 211/59.2
5,368,172 A 11/1994 Barringer
5,533,632 A * 7/1996 Patterson ..... A47F 5/025 198/678.1
5,579,895 A * 12/1996 Davis, Jr. ..... B65B 35/405 198/456
5,711,431 A * 1/1998 Reichert ..... A47F 5/0884 211/122
6,131,748 A * 10/2000 Kawasaki ..... A47F 1/128 211/54.1
6,491,155 B2 * 12/2002 Garioni ..... B66C 1/42 198/470.1
7,654,387 B2 * 2/2010 Armstrong ..... B65G 15/08 198/836.1
8,439,181 B2 * 5/2013 Hausladen ..... B08B 9/426 198/470.1
8,720,670 B2 * 5/2014 Schulnig ..... B65G 47/847 198/470.1
8,851,881 B2 * 10/2014 Zacche ..... B29C 49/4205 198/459.1
9,248,362 B2 2/2016 Durant
2001/0037930 A1 * 11/2001 Bollegraaf ..... B65G 17/063 198/836.1
2003/0034227 A1 * 2/2003 Gerber ..... B65G 47/847 198/473.1
2003/0080079 A1 5/2003 Wu
2004/0094389 A1 * 5/2004 Boyce ..... B65G 17/323 198/377.01
2004/0195075 A1 * 10/2004 Orndorff ..... B65G 23/30 198/459.1
2004/0222177 A1 * 11/2004 Shai ..... B65G 69/165 211/121
2005/0060823 A1 * 3/2005 Lord ..... H01L 21/67712 15/77
2007/0012633 A1 * 1/2007 McKinney, Jr. ..... A47G 25/746 211/1.56
2009/0277750 A1 * 11/2009 Dewert ..... B65G 47/846 198/470.1
2009/0308884 A1 * 12/2009 Coughlin ..... G07F 11/52 221/15
2010/0059332 A1 * 3/2010 Cuypers ..... B65B 35/26 198/348
2014/0263119 A1 * 9/2014 Gruger ..... A47F 7/0028 211/85.7
2016/0106208 A1 * 4/2016 Kirkpatrick ..... A47B 71/00 211/85.4
2018/0036446 A1 * 2/2018 Rice ..... A61L 9/046

* cited by examiner

STORAGE RACK AND CONVEYOR FOR SPORTS EQUIPMENT

FIELD

The present disclosure pertains to systems and methods for storing, organizing, and/or conveying objects in a selected order, such as sports equipment.

BACKGROUND

Sports played on a court such as pickleball, tennis, badminton, etc., are popular, and at public courts and clubs there are typically players waiting to play. In order to keep track of the order of players, players often arrange their racquets or other sporting equipment in the order of who is next up to play. Such arrangements may be made by putting racquets into openings in a chain link fence, or arranging racquets in a line on the ground, on a bench, etc. Players that are next up to play retrieve their racquets from the head of the line, and players coming off the court place their racquets at the end of the line. The problem with such arrangements is that each time a new player is up to play, all racquets in the line must be advanced. Where racquets are placed in a fence, racquets may fall and the player's place in line may be lost. Placing racquets on the ground or in a fence can also subject them to damage. Accordingly, there is a need for improvements to systems for organizing and conveying sports equipment to determine the order of play.

SUMMARY

The present disclosure concerns systems and methods for storing, organizing, and/or conveying objects, such as sports equipment. In a representative embodiment, an assembly comprises a first pulley, a second pulley spaced apart from the first pulley, and a continuous belt extending between the first pulley and the second pulley. The belt is movable by rotation of the first pulley and the second pulley. The assembly further comprises a plurality of engagement members coupled to and movable with the belt such that the engagement members travel along a path extending from the first pulley to the second pulley and back to the first pulley when the belt is in motion, the engagement members being configured to engage and convey sports equipment along the path. The assembly also includes a stop member located along the path of the engagement members. The second pulley is spaced apart from the first pulley along a first axis, and the second pulley is spaced apart from the first pulley along a second axis that is perpendicular to the first axis such that the belt is inclined toward the second pulley, and such that sports equipment engaged with an engagement member beneath the first pulley will advance toward the second pulley. The stop member is offset from the path of the engagement members such that when the belt is in motion, empty engagement members proceed along the path beyond the stop member, and the stop member is configured to stop motion of the belt upon contacting sports equipment conveyed by an engagement member.

In some embodiments, the first pulley, the second pulley, and the belt are at least partially enclosed in a housing, and the engagement members extend out of the housing such that the path of the engagement members extends around an exterior of the housing.

In some embodiments, the stop member is disposed beneath the second pulley.

In some embodiments, the engagement members are angled relative to the belt such that sports equipment coupled to engagement members beneath the belt hang parallel to the second axis.

In some embodiments, each engagement member comprises a support member coupled to the belt at one end, and a pair of clamping members extending from the support member at the other end such that the clamping members are offset from the belt along the second axis.

In some embodiments, the first pulley is configured to rotate about a first rotation axis, the second pulley is configured to rotate about a second rotation axis, and the clamping members extend from the support members parallel to the first and second rotation axes.

In some embodiments, the clamping members are configured to engage sports equipment to be conveyed along the path such that longitudinal axes of the conveyed sports equipment are oriented perpendicular to the axes of rotation of the first and second pulleys.

In some embodiments, a motor is coupled to the first pulley or to the second pulley to drive the belt.

In some embodiments, the stop member comprises a limit switch configured to stop operation of the motor when the limit switch contacts sports equipment conveyed by an engagement member.

In some embodiments, the assembly further comprises a base having a first portion configured to be mounted to a support, and a second portion coupled to the first portion and offset from the first portion. The first pulley and the second pulley are coupled to the second portion of the base such that at least a portion of the path of the engagement members is offset from the first portion of the base.

In some embodiments, the base further comprises a third portion between the first portion and the second portion, the third portion extending outwardly from the first portion such that the second portion is spaced apart from the first portion.

In some embodiments, the engagement members are configured to engage handles of sports equipment, and the base further comprises a tray configured to receive game balls.

In some embodiments, the first and second pulleys are coupled to an opposite side of the second portion of the base from the tray.

In some embodiments, the stop member is coupled to the second portion of the base, and comprises an extension portion oriented perpendicular to the direction of motion of engagement members along the path.

In another representative embodiment, an assembly comprises a first pulley configured to rotate about a first rotation axis, a second pulley spaced apart from the first pulley and configured to rotate about a second rotation axis, and a continuous belt extending between the first pulley and the second pulley and movable by rotation of the first pulley and the second pulley. A plurality of engagement members are coupled to and movable with the belt such that the engagement members travel along a path extending from the first pulley to the second pulley and back to the first pulley when the belt is in motion, the engagement members being configured to engage and convey sports equipment along the path such that longitudinal axes of the conveyed sports equipment are oriented perpendicular to the axes of rotation of the first and second pulleys. A stop member is located along the path of the engagement members and offset from the path of the engagement members. The stop member is configured to allow empty engagement members to proceed along the path beyond the stop member, and to stop motion of the belt upon contacting sports equipment conveyed by an engagement member.

In some embodiments, the first pulley, the second pulley, and the belt are at least partially enclosed in a housing, and the engagement members extend out of the housing such that the path of the engagement members extends around an exterior of the housing.

In some embodiments, the stop member is disposed beneath the second pulley.

In some embodiments, the second pulley is spaced apart from the first pulley along a first axis, and the second pulley is spaced apart from the first pulley along a second axis that is perpendicular to the first axis such that the belt is inclined toward the second pulley, and the engagement members are angled relative to the belt such that sports equipment coupled to engagement members beneath the belt hang parallel to the second axis.

In some embodiments, each engagement member comprises a support member coupled to the belt at one end, and a pair of clamping members extending from the support member at the other end such that the clamping members are offset from the belt along the second axis.

In another representative embodiment, a method comprises coupling an assembly to a support, the assembly comprising a first pulley, a second pulley spaced apart from the first pulley, and a continuous belt extending between the first pulley and the second pulley and movable by rotation of the first pulley and the second pulley. The assembly further comprises a plurality of engagement members coupled to and movable with the belt such that the engagement members travel along a path extending from the first pulley to the second pulley and back to the first pulley when the belt is in motion, the engagement members being configured to engage and convey sports equipment along the path. The assembly further comprises a stop member located along the path of the engagement members. The second pulley is spaced apart from the first pulley along a first axis, and the second pulley is spaced apart from the first pulley along a second axis that is perpendicular to the first axis such that the belt is inclined toward the second pulley, and such that sports equipment engaged with an engagement member beneath the first pulley will advance toward the second pulley. The stop member is offset from the path of the engagement members such that when the belt is in motion, empty engagement members proceed along the path beyond the stop member, and the stop member is configured to stop motion of the belt upon contacting sports equipment conveyed by an engagement member.

The foregoing and other objects, features, and advantages of the disclosed technology will become more apparent from the following detailed description, which proceeds with reference to the accompanying figures.

DETAILED DESCRIPTION

The present disclosure pertains to systems and methods for storing, organizing, and conveying sports equipment such as paddles, racquets, bats, or any other object including a long handle or neck. In some embodiments, the systems comprise a conveyor assembly including two pulleys spaced apart in two axes, and a belt extending between the pulleys. The belt can be angled or sloped from the first pulley toward the second pulley. Objects to be conveyed, such as paddles, can be coupled to engagement members on the lower span of the belt such that the paddles hang vertically from the belt. The weight of the paddles hanging from the belt above or upstream of the second pulley can cause the belt to move around the pulleys, conveying the paddles toward the lower second pulley (in other words, motion of the belt can be gravity-driven). A stop member positioned in or adjacent the path of the engagement members can stop the belt upon contacting a paddle, while letting empty engagement members pass. In this manner, players can engage their paddles with the engagement members on the belt in a desired order of play, and the conveyor system can automatically advance the paddles toward the stop member while preserving the selected order. Players who are next up to play can remove their paddles stopped at the stop member, and players wishing to be added to the queue can add their paddles to empty or open engagement members on the belt upstream of the second pulley.

Figure 1:
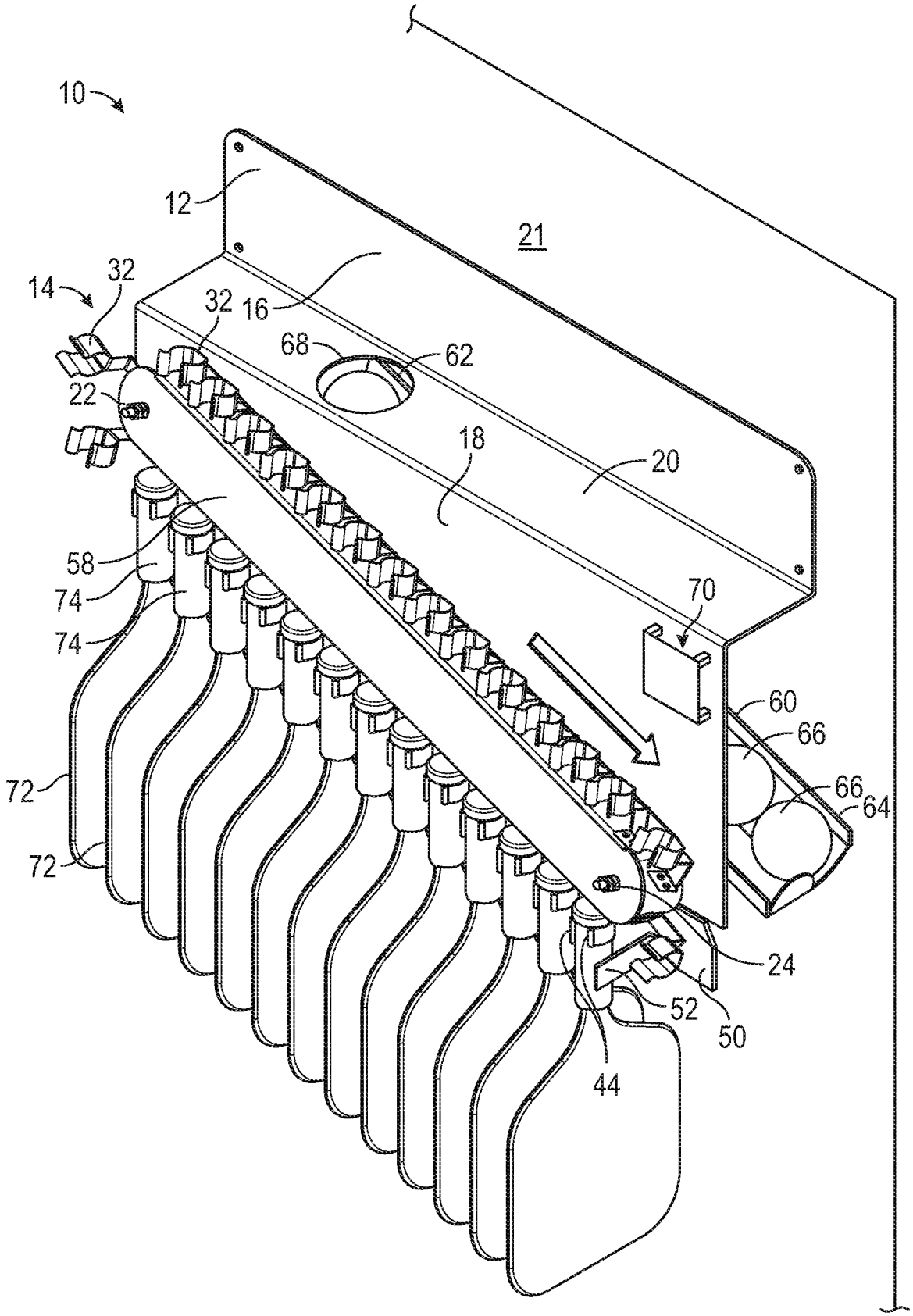
FIG. 1 is a perspective view of a system for storing and conveying objects such as sports equipment, according to one embodiment.
Figure 2:
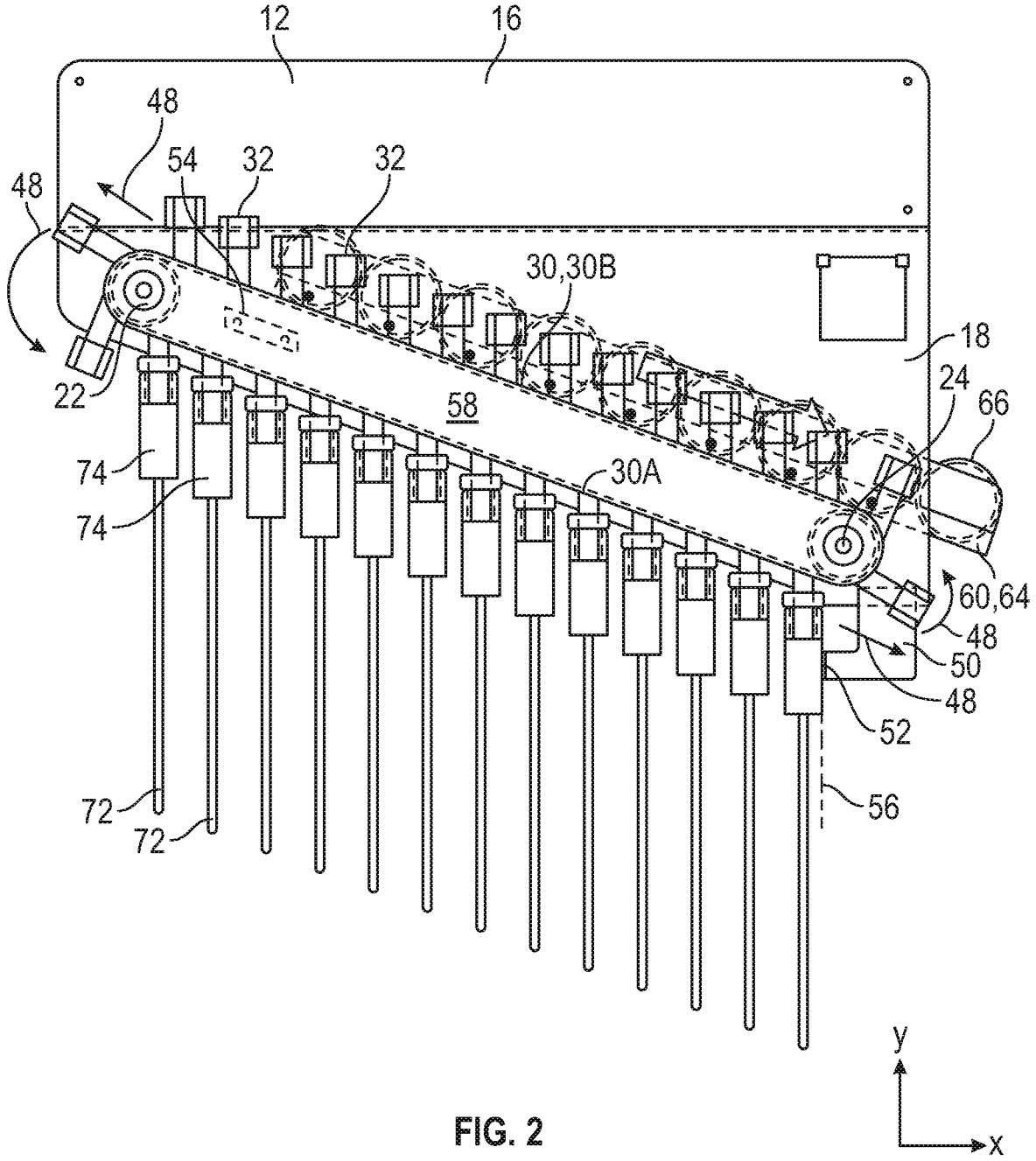
FIG. 2 is a front elevation view of the system of FIG. 1.

FIGS. 1 and 2 illustrate a representative embodiment of an assembly 10 including a base 12 and a conveyor system (also referred to as a "conveyor assembly") generally indicated at 14 mounted to the base. The base 12 can comprise a first portion 16, a second portion 18, and a third portion 20. The third portion 20 can extend outwardly from one edge of the first portion 16 and perpendicular to the first portion. As used herein, unless stated in absolute terms such as "completely perpendicular," the term "perpendicular" includes the term "substantially perpendicular." For example, an object is substantially perpendicular with respect to a reference object or plane when the object is oriented at an angle of between 70° to 110° with respect to the reference object or plane.

The second portion 18 can extend from an edge of the third portion 20 that is opposite the first portion 16, and can be parallel to the first portion 16. In other words, the second portion 18 can be offset from the first portion 16 by the third portion 20. As used herein, unless stated in absolute terms such as "completely parallel," the term "parallel" includes the term "substantially parallel." For example, an object is substantially parallel with respect to a reference object or plane when the object is oriented at an angle of ±20° or less with respect to the reference object or plane. In certain embodiments, the first portion 16 can be configured for mounting on a support 21, such as on a wall, a beam, a post, etc., and such that the second portion 18 is offset from the support by the third portion 20.

In certain embodiments, the first, second, and third portions 16-20 of the base 12 can be integrally formed with one another. As used herein, the terms "unitary construction" and "integrally formed" refer to a construction that does not include any welds, fasteners, or other means for securing separately formed pieces of material to each other. For example, in certain embodiments the base 12 can comprise stamped sheet metal, or molded plastic. In other embodiments, the various portions of the base 12 can be separately formed and secured together.

Figure 3:
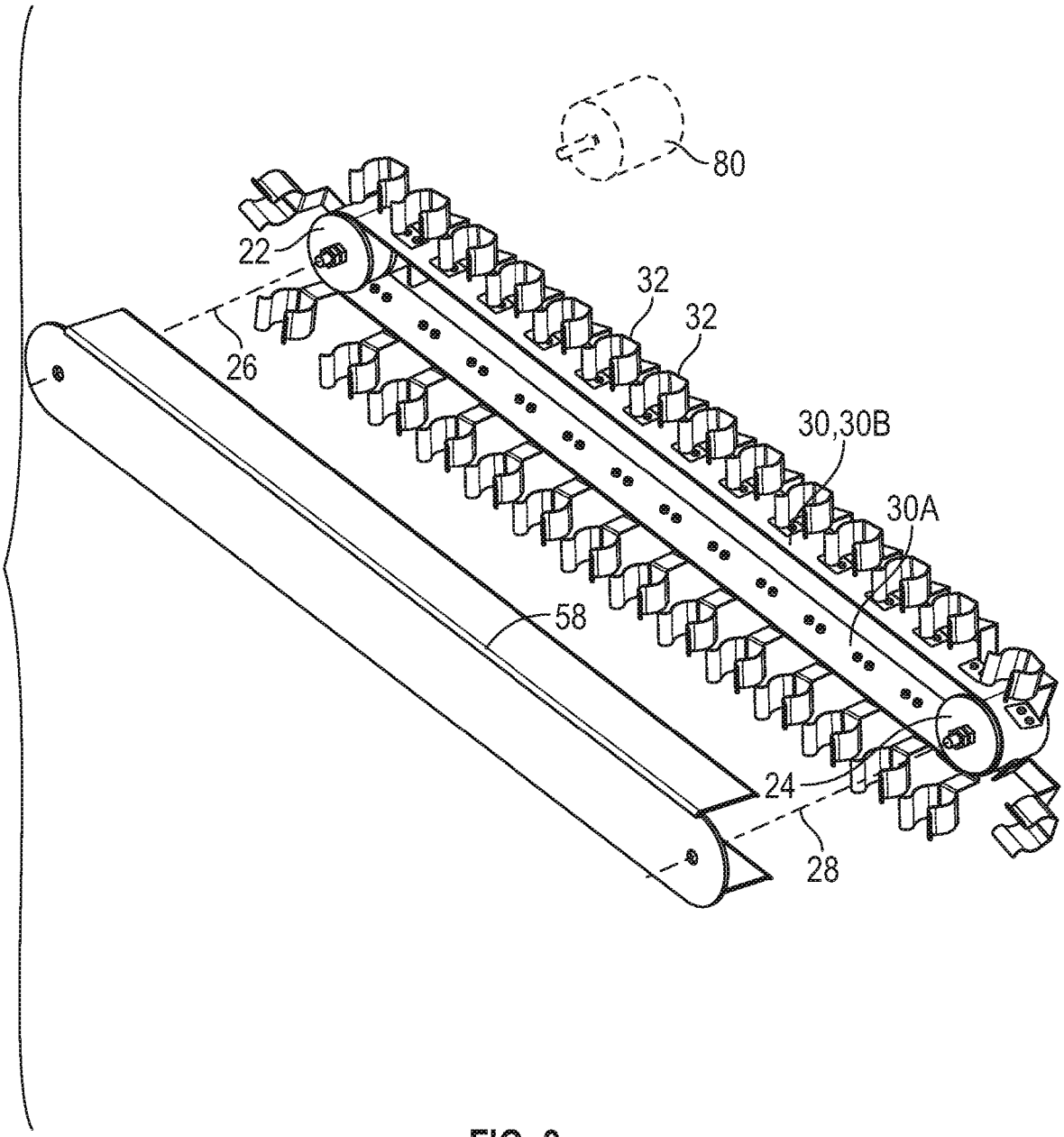
FIG. 3 is a perspective view of the conveyor assembly of FIG. 1 shown with the housing removed.

The conveyor assembly 14 can be coupled to the second portion 18 of the base 12. Referring to FIGS. 2 and 3, the conveyor assembly 14 can comprise a first rotatable member or drum configured as a pulley 22 and a second rotatable member or drum configured as a pulley 24. The first pulley 22 can be rotatable about a first rotation axis 26 and the second pulley 24 can be rotatable about a second rotation axis 28. In the illustrated configuration, the first pulley 22 and the second pulley 24 can be spaced apart from each other in two dimensions. For example, with reference to the Cartesian coordinate axes in FIG. 2, the pulleys 22 and 24 can be spaced apart along the x-axis (also referred to as a "first axis"), and spaced apart along the y-axis (also referred to as a "second axis"). Thus, when the assembly 10 is mounted to a wall with the third portion 20 of the base 12 level with the ground, the first pulley 22 can be higher than the second pulley 24.

Still referring to FIGS. 2 and 3, an endless or continuous belt 30 can extend from the first pulley 22 to the second pulley 24, and back to the first pulley 22. The belt 30 can comprise a continuous or monolithic strip of material (e.g., a polymeric material, or a metal-polymer composite material), or a plurality of links in the manner of a chain. The belt 30 can be engaged by the first and second pulleys 22, 24 (e.g., frictionally, or optionally by one or more sprockets) such that rotation of the pulleys causes corresponding motion of the belt around the pulleys. Due to the separation of the pulleys 22 and 24 along the x- and y-axes, the belt 30 can be inclined or sloped relative to the ground plane such that both the upper and lower spans 30B, 30A of the belt are angled downwardly toward the second pulley 24. In certain embodiments, motion of the belt 30 can be counterclockwise with respect to the rotation axes 26 and 28 of the pulleys such that objects on the lower span 30A of the belt move in a direction from the first pulley 22 toward the second pulley 24, and objects on the upper span 30B of the belt move from the second pulley toward the first pulley. Referring to FIG. 2, in certain embodiments the first pulley 22 can be movably coupled to a tensioner 54 to vary the distance between the first and second pulleys and thereby adjust the tension of the belt 30.

Figure 4:
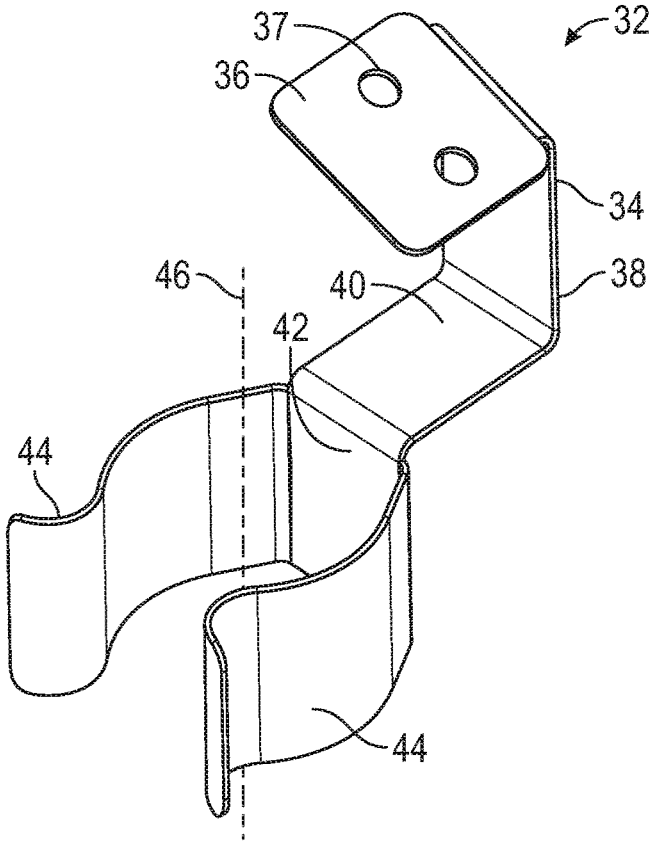
FIG. 4 is a perspective view of a representative embodiment of an engagement member.

The belt 30 can comprise a plurality of engagement members generally indicated at 32 that are coupled to the belt and spaced apart from each other along the belt. FIG. 4 illustrates a representative engagement member 32 in greater detail. The engagement member 32 can comprise a support member 34 including a first portion configured as a coupling portion 36. A second portion 38 can extend at an angle (e.g., a 90° angle) from the coupling portion 36, and a third portion 40 can extend from the second portion 38 at an angle (e.g., a 90° angle) such that the first, second, and third portions 36-40 define a C-shaped cross-section. A fourth portion 42 can extend from the third portion 40 parallel to the second portion 28. A pair of clip or clamp members 44 can extend from the fourth portion 42 in the manner of spring clamp. The clamp members 44 can be configured to engage or clamp objects received between the clamp members, such as the handle of a racquet or other sports equipment.

Figure 5:
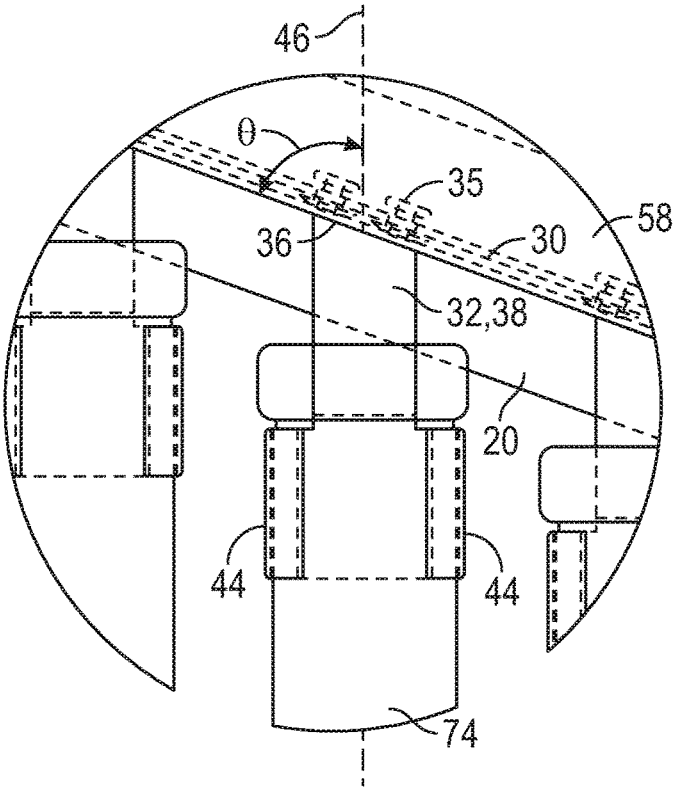
FIG. 5 is a magnified view of a portion of the lower span of the belt of FIG. 1 illustrating engagement members coupled to the belt, and sports equipment engaged with the engagement members.

Referring to FIGS. 2, 4, and 5, in the illustrated embodiment the engagement members 32 may be coupled to the exterior or radially outward surface of the belt 30. The engagement members 32 can be coupled to the belt 30 by fasteners 35 such as rivets, screws, or other fastening means inserted through openings 37 defined in the coupling portion 36 (FIG. 4). Referring specifically to FIGS. 4 and 5, the coupling portion 36 may also be oriented at an angle θ to a longitudinal axis 46 extending through the space defined between the clamp members 44. In certain embodiments, the angle θ can be equal, or substantially equal, to the angle of the upper and lower spans of the belt with a level ground plane. In certain embodiments, the axis 46 can correspond to, or be parallel with, the longitudinal axis of objects clamped by the engagement members to be conveyed along the assembly. For example, FIG. 5 illustrates the axis 46 extending along handles 74 of paddles 72 clamped or gripped by the engagement members, as described further below.

With reference to FIG. 2, as the belt 30 moves the engagement members 32 can be conveyed along a path generally indicated by arrows 48. The path can extend from beneath the first pulley 22 to the second pulley 24 along the lower span 30A of the belt 30, and from the second pulley back to first pulley along the upper span 30B of the belt. Referring to FIGS. 1-3, the conveyor assembly 14 can be at least partially received in a cover or housing 58 that is coupled to the second portion 18 of the base 12. The housing 58 can extend over the upper and lower spans 30B, 30A of the belt 30. However, the support members 34 of the engagement members 32 can extend around the housing 58 such that the clamp members 44 are disposed outside the housing. Thus, the path of at least the clamp members 44 of the engagement members 32 extends around the exterior of the housing 58.

Referring to FIGS. 1 and 2, a stop member configured as a bracket member 50 can be positioned along the path and coupled to the second portion 18 of the base 12. The bracket member 50 can comprise a tab portion or extension portion 52 disposed in line with the path of the clamp members 44, but offset from the path of the clamp members along the y-axis (e.g., downwardly). In other words, the tab portion 52 can be located beneath the clamp members 44 of the lowermost engagement member 32 as the lowermost engagement member approaches the second pulley 24.

The tab portion 52 of the stop member 50 can define a stop location or stop plane 56 along the x-axis at which objects conveyed by the assembly 14 can be stopped by the tab portion. With reference to FIG. 2, in the illustrated embodiment the stop plane 56 is offset from the rotation axis of the second pulley 24 by a small distance along the x-axis (e.g., upstream of the rotation axis relative to the direction of motion of the belt 30), although in other embodiments the stop member and corresponding stop plane may located at any location along the belt. In embodiments in which the conveyor assembly 14 is configured to store and/or convey sports equipment such as paddles, positioning a paddle at the stop plane 56 can indicate that the owner of that paddle is next up for play, as further described below.

Returning to FIGS. 1 and 2, in the illustrated embodiment the assembly 10 can further comprise a tray 60 including a first end portion 62 and a second end portion 64. The tray 60 can be coupled to the second portion 18 of the base 12 on the opposite side of the second portion from the conveyor assembly 14, and can be inclined to dispose game balls 66 received in the tray to roll toward the second end portion 64. The third portion 20 of the base 12 can define an opening 68 through which game balls 66 can be dropped into the tray 60.

Referring again to FIG. 1, in certain embodiments the base 12 can comprise a display area 70 configured to receive a card or other indicator specifying information such as the type of game or sport being played, the skill level or rank of players, the number or identification of the court or field with which the assembly 10 is associated, etc. In certain embodiments, the display area 70 can comprise a screen or electronic display for displaying information related to the assembly 10, or information related to users.

In use, objects to be stored or conveyed using the assembly 10 can be inserted between the clamping members 44 of the engagement members 32 such that the objects are gripped by the clamping members 44. In the illustrated embodiment, the exemplary objects to be conveyed are paddles 72 such as may be used for playing pickleball or table tennis. With the handles 74 of the paddles 72 clamped between the clamp members 44, the paddles 72 can hang from the engagement members 32 with their axes (e.g., longitudinal axis 46 of FIGS. 4 and 5) oriented perpendicular to the rotational axes 26 and 28 of the pulleys 22 and 24. Owing to the inclined orientation of the belt 30, the weight of the paddles 72 hanging from the lower span 30A can cause the belt 30 to move around the pulleys 22 and 24 such that the paddles are conveyed toward the stop member 50. Because the tab portion 52 of the stop member 50 is offset from the clamp members 44, empty engagement members 32 with no paddle attached to them can proceed beyond the tab portion 52 as the belt moves. However, as shown in FIGS. 1 and 2, upon contacting the handle 74 of a paddle 72, the tab portion 52 can stop further motion of the belt, and thus halt further advancement of paddles along the path.

A paddle 72 in contact with the stop member 50, and thereby stopped at the stop plane 56, can indicate that the owner of that paddle is next up at play. When the paddle 72 is removed from the respective engagement member 32, the belt 30 can automatically advance the remaining paddles along the path until the next paddle contacts the stop member 50. In this manner, the assembly 10 can maintain the paddles in a selected order, can indicate who is next up to play by positioning that player's paddle at the stop member 50, and can automatically advance the position of players' paddles along the path in the selected order as paddles are removed and added without requiring further interaction with the assembly 10. In some embodiments, one or both of the pulleys 22 and 24, and/or the belt 30, can comprise a pulley speed tensioner, a belt speed tensioner, and/or a clutch bearing configured to slow the rate of advance of the belt along the path. In embodiments with a pulley speed tensioner, the pulley speed tensioner can apply friction to the pulley in order to slow the rate of rotation of the pulley, and thereby control the speed of the belt.

In other embodiments, the system may be used to convey any of a variety of objects, including sports equipment such as pickleball paddles, tennis racquets, table tennis paddles, badminton racquets, squash racquets, baseball bats, golf clubs, etc. The systems described herein may also be used to store and convey any other type of object where it is desired to preserve a selected order of the objects, such as name badges (e.g., indicating a selected player order, such as a batting order), food or beverage containers, tools, etc.

In other embodiments, the system 10 may also be driven by an electric motor 80 shown in dashed lines in FIG. 2. The motor 80 is shown positioned for coupling to the first pulley 22, but could be coupled to the second pulley 24 as well. In other embodiments, a motor can be coupled to each of the pulleys. In such embodiments, the stop member 50 can be configured as a limit switch. In certain embodiments, the limit switch can be electrically coupled to a relay that is normally closed such that power is provided to the motor(s) 80 until the limit switch is contacted by an object such as a paddle 72 being conveyed along the path. Contact by the paddle 72 can engage the limit switch, opening the relay circuit and causing the motor 80 to stop with the paddle 72 at a selected position along the path.

In other embodiments, the engagement members 32 can comprise any of a variety of other structures for engaging objects, including magnets, hooks, clips, alligator clips, cradles, etc.

Figure 6:
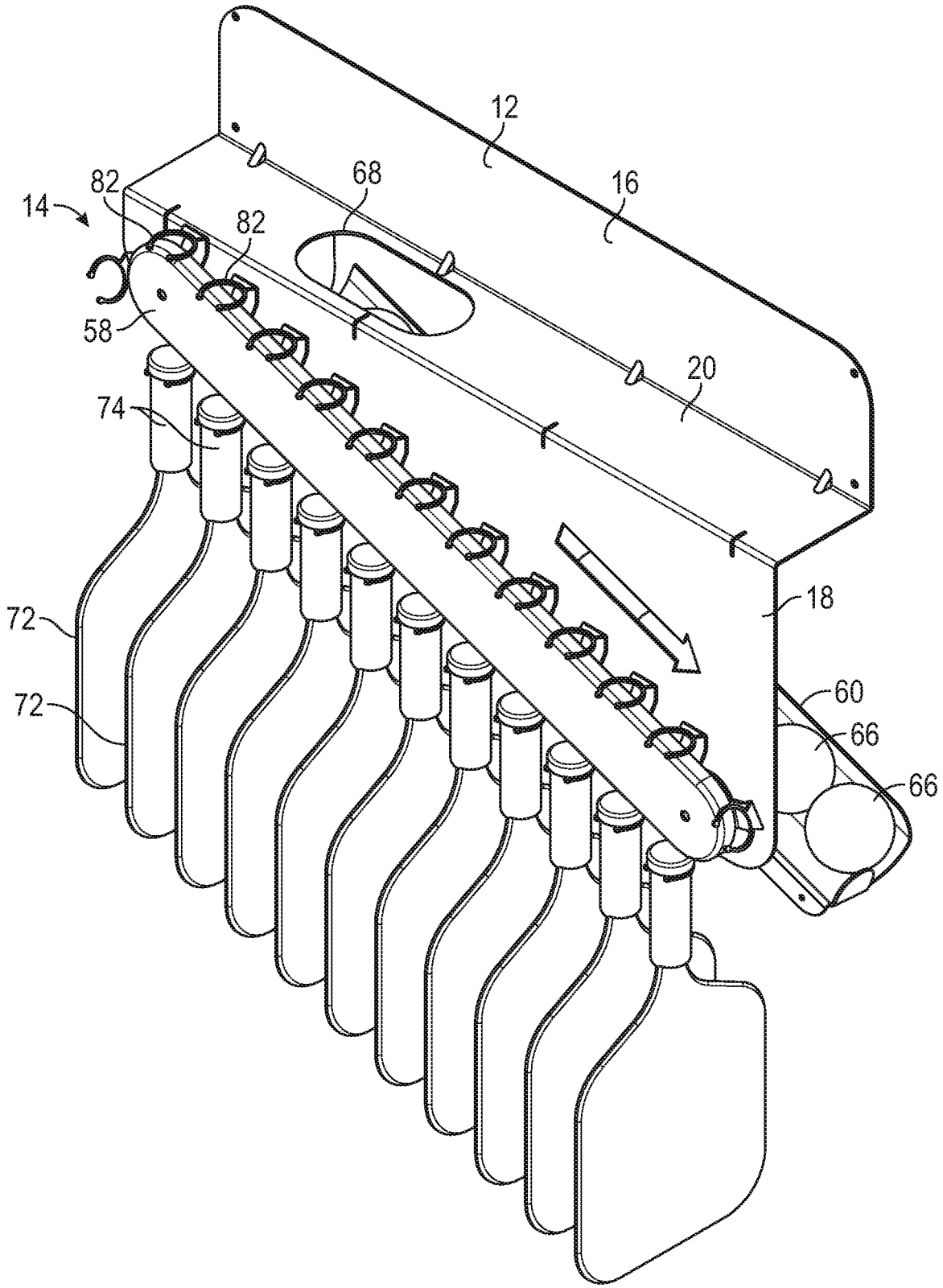
FIG. 6 is a perspective view of another embodiment of a system for storing and conveying sports equipment.
Figure 7:
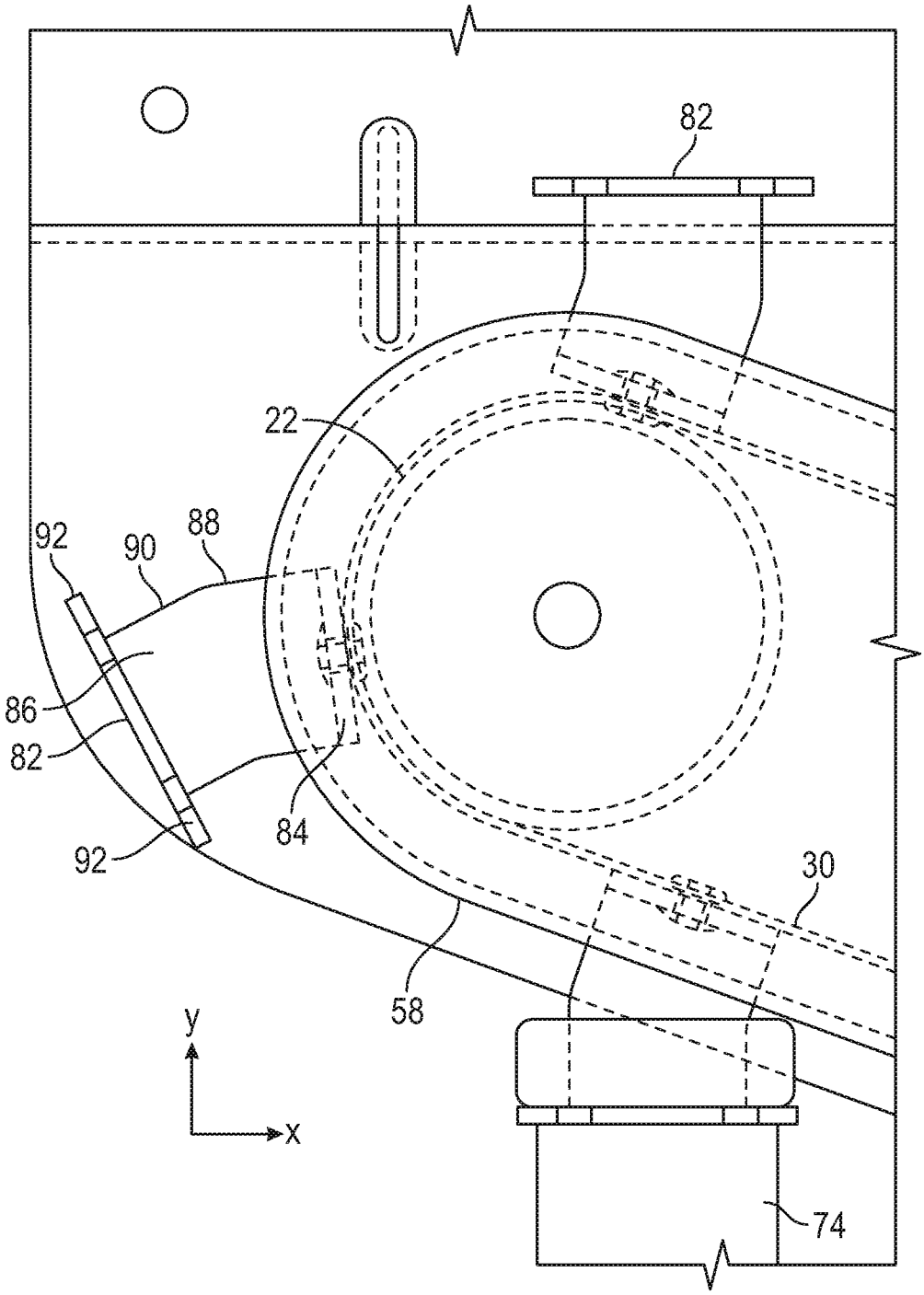
FIG. 7 is a magnified view of a pulley, belt, and engagement members of the system of FIG. 6.

FIGS. 6 and 7 illustrate another embodiment of the system 10 comprising another configuration of engagement members 82. Referring to FIG. 7, the engagement members 82 can comprise support members 86 having a first portion or coupling portion 84 that is coupled to the belt 30. A second portion 88 extends from the coupling portion 84 outwardly from the housing 58, and a third portion 90 extends from the second portion 88 and at angle to the second portion 88. The angle can be configured such that clipping or clamping members 92 that extend from the third portion 90 are perpendicular to the longitudinal axes of paddle handles 74 engaged by the clamping members 92. This can allow the paddles 72 to hang vertically along the y-axis when suspended from the lower span of the belt 30. In certain embodiments, the system shown in FIGS. 6 and 7 can include a stop member similar to the stop member 50.

Figure 8:
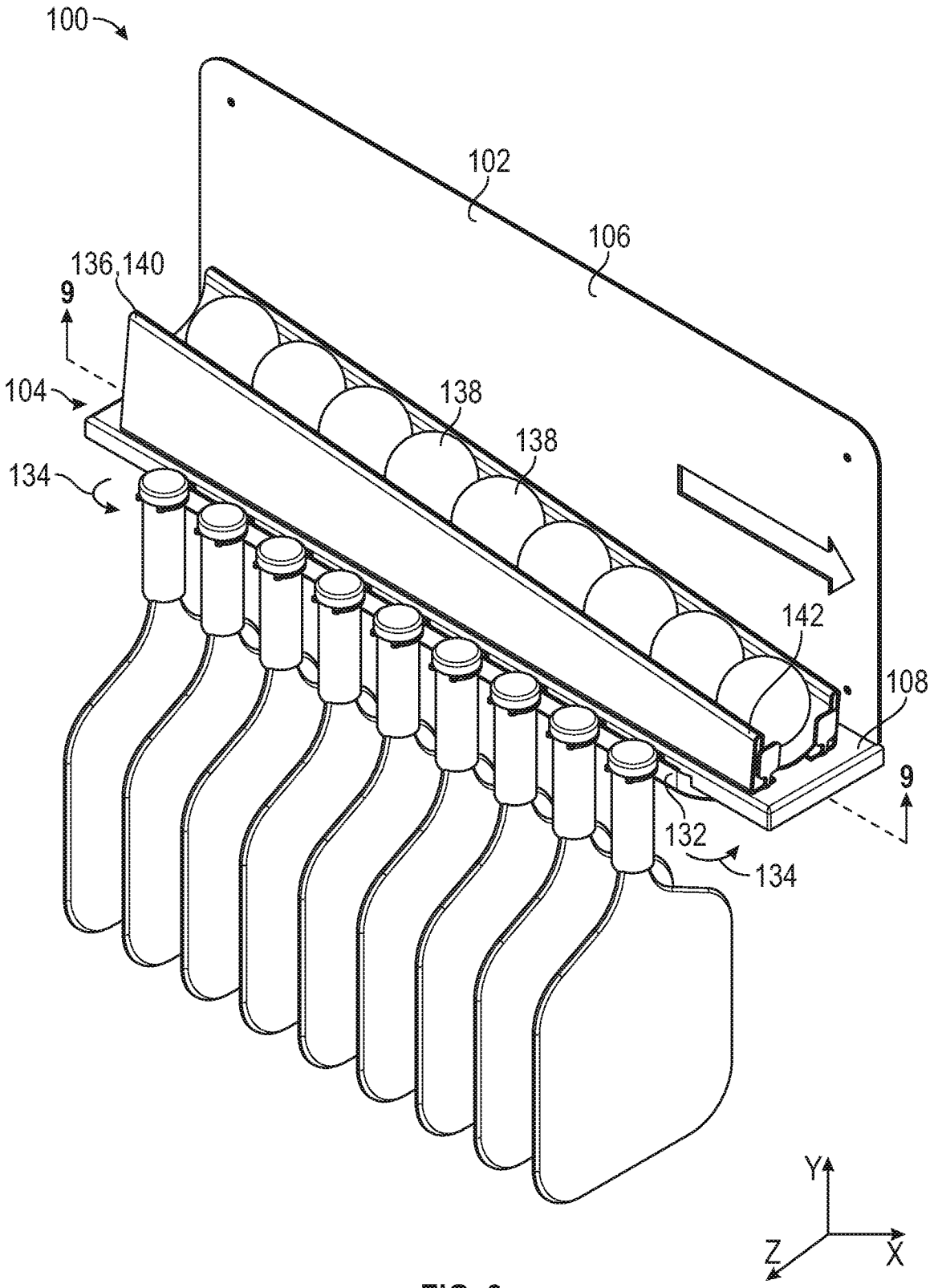
FIG. 8 is a perspective view of another embodiment of a system for storing and conveying sports equipment in which the two pulleys are positioned at the same height.
Figure 9:
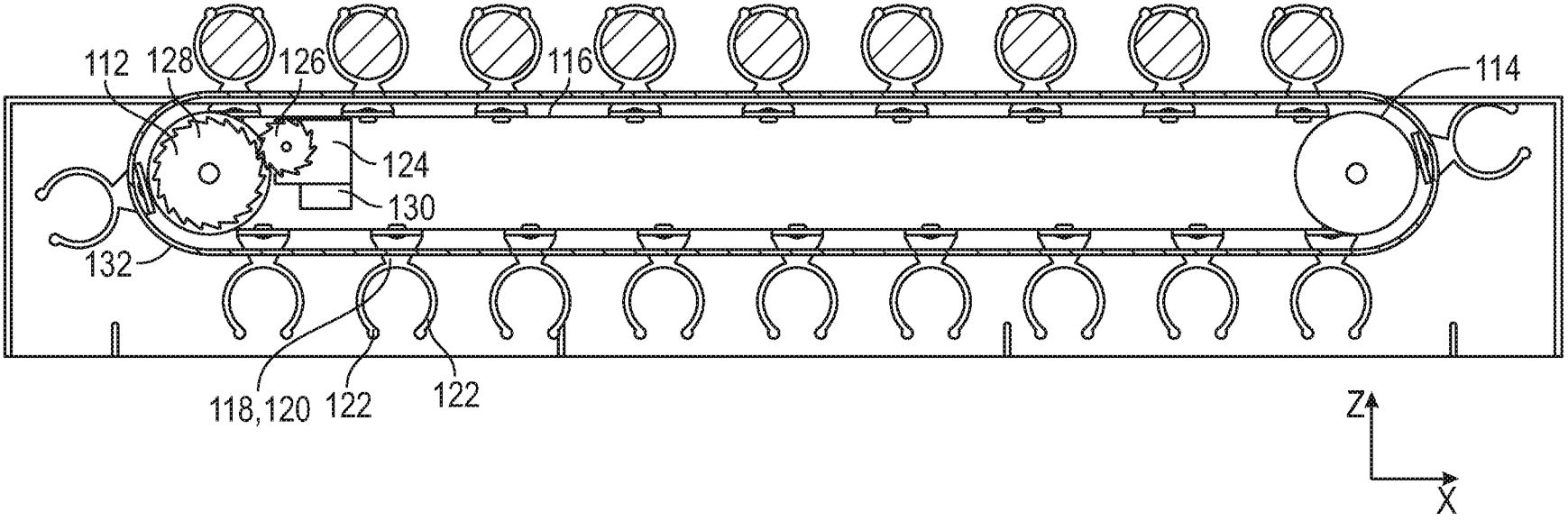
FIG. 9 is a partial cross-sectional bottom plan view of the system of FIG. 8 taken along line 9-9 of FIG. 8.

FIGS. 8 and 9 illustrate another embodiment of a system 100 including a base 102 and a conveyor assembly 104 mounted to the base. The base 102 can comprise a first portion 106, and a second portion 108 extending outwardly from a lower edge of the first portion 106 and perpendicular to the first portion. In certain embodiments, the first portion 106 can be configured for mounting on a support such as a wall, a beam, a post, etc., similar to the embodiment of FIG. 1.

The conveyor assembly 104 can be contained at least partially within a cover or housing 132. The housing 132 can be coupled to the second portion 108 of the base 102, such as to the lower surface of the second portion 108. FIG. 9 illustrates a bottom plan view of the assembly 100 taken along the line 9-9 of FIG. 8. The conveyor assembly 104 can comprise a first pulley 112 and a second pulley 114. The first pulley 112 and the second pulley 114 can be rotatable about respective axes extending into and out of the plane of the page in FIG. 9 (e.g., parallel to the y-axis in FIG. 8). The first pulley 112 and the second pulley 114 can be spaced apart from each other along the x-axis, but can otherwise be at the same elevation (e.g., at the same location along the y-axis). A belt 116 can extend from the first and second pulleys 112, 114 such that rotation of the pulleys causes corresponding motion of the belt around the pulleys. In certain embodiments, one or both of the first pulley 112 and the second pulley 114 can be movably coupled to a belt speed tensioner and/or a pulley speed tensioner as described above to control the rotational speed of the belt 116.

The belt 116 can comprise a plurality of engagement members 118 coupled to and spaced apart along the belt 116.

The engagement members 118 can comprise support members 120 coupled to the belt 116 at one end, and including clipping or clamping arms 122 at the opposite end of the support members. In certain embodiments, the clamping members 118 can be configured as spring clamps, as described above. In certain embodiments, the belt can be contained in the housing 132, and the clamping arms 122 can extend out of the housing 132.

The conveyor assembly 104 can comprise a motor 124 coupled to a first gear 126. The first gear 126 can be meshed with a second, larger gear 128 coupled to, or incorporated in, the first pulley 112. Rotation of the gears 126 and 128 by the motor 124 can drive the pulley 112 and move the belt 116, thereby moving the engagement members 118 in a path around the housing 132 indicated by arrows 134 (FIG. 8). In certain embodiments, power to the motor 124 can be provided by a battery 130. In certain embodiments, the assembly 100 can comprise a stop member configured as a limit switch (not shown). The limit switch can be positioned and configured as described with reference to the embodiments above.

Referring to FIG. 8, in some embodiments the assembly 100 can comprise a tray 136 configured to receive game balls 138. The tray 136 can be disposed on the upper surface of the second portion 108 of the base on the opposite side as the conveyor assembly 104. The tray 136 can be sloped such that game balls 138 received in the higher first portion 140 of the tray roll toward the lower second portion 142 of the tray.

Figure 10:
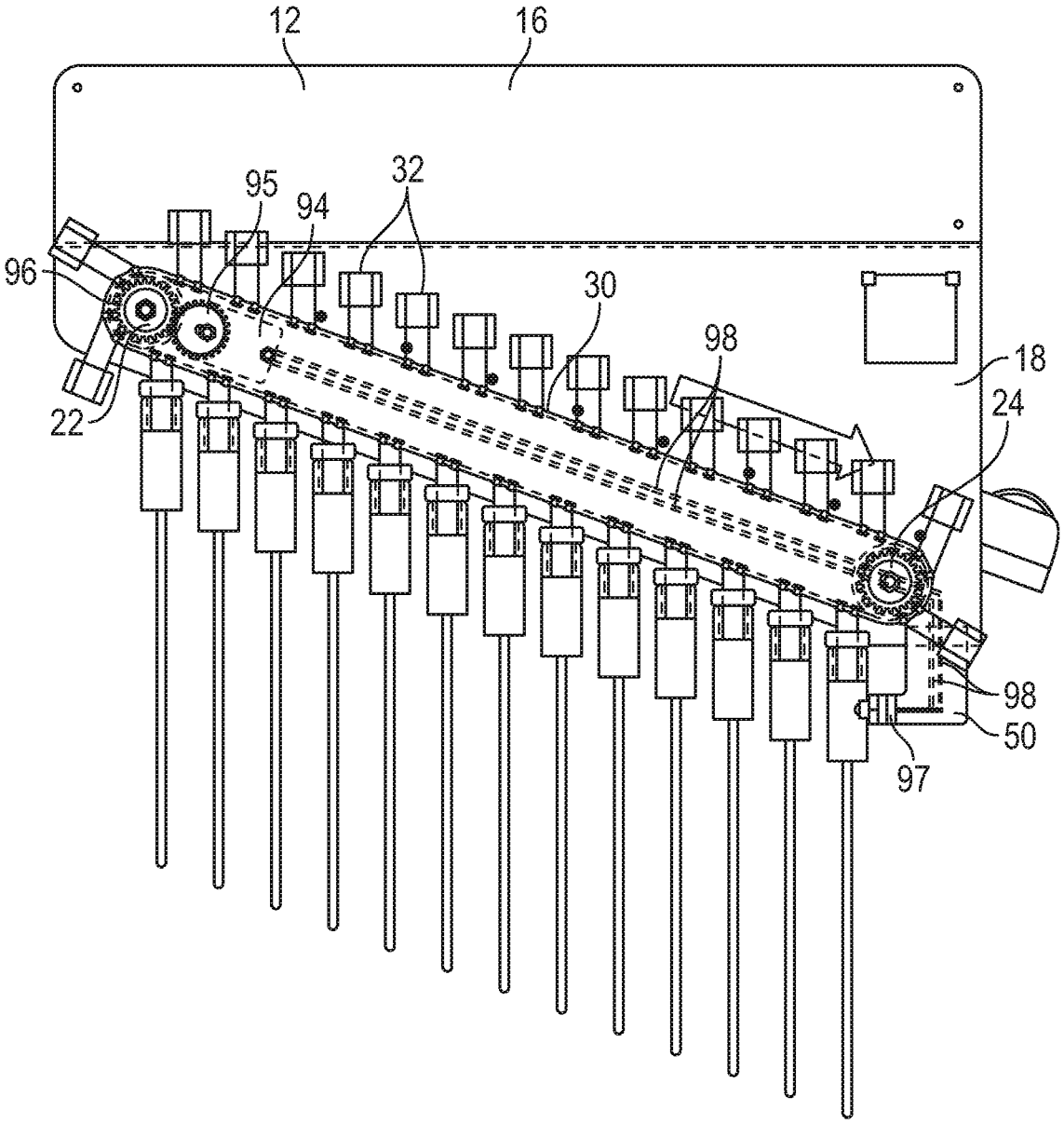
FIG. 10 is a side elevation view of another embodiment of the system of FIG. 1 including a motor coupled to the first pulley.

FIG. 10 illustrates another embodiment of the assembly 10 with the housing 58 removed for purposes of illustration. The belt 30 of the assembly 10 of FIG. 10 can be driven by a motor 94 mounted to the second portion 18 of the base 12 adjacent the first pulley 22. The motor 94 can include a gear 95 meshed with a gear 96 coupled to the first pulley 22 to rotate the pulley 22 and drive the belt 30. In certain embodiments, the motor 94 can be mounted to the opposite side of the second portion 18 as the pulley 22, and the shaft of the motor can extend through the portion 18 such that the gear 96 and the gear 95 are on the same side of the portion 18 as one another. In other embodiments, the motor 94 can be mounted to the same side of the portion 18 as the pulley 22, and can be received within the belt cover housing 58. In yet other embodiments, the motor 94 can be mounted at the opposite end of the portion 18 and the gear 96 can be meshed with a corresponding gear on the second pulley 24. In further embodiments, the system can include a motor coupled to each pulley.

The stop member 50 can include a limit switch 97 configured substantially as described above, and positioned adjacent the path of the engagement members 32 to stop the motor 94 upon contacting a paddle or other object conveyed by the engagement members. For example, in certain embodiments the limit switch 97 can be mounted to the tab portion 52 (FIG. 1). Wires 98 can electrically connect the motor 94 with the limit switch 97. In some embodiments, the wires 98 can be routed through openings in the stop member 50 and/or in the portion 18, and can extend along the back side of the portion 18 to the motor 94.

General Considerations

For purposes of this description, certain aspects, advantages, and novel features of the embodiments of this disclosure are described herein. The disclosed methods, apparatus, and systems are not limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved. The scope of this disclosure includes any features disclosed herein combined with any other features disclosed herein, unless physically impossible.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed components can be used in conjunction with other components.

As used in this disclosure and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In some examples, values, procedures, or apparatus may be referred to as "lowest," "best," "minimum," or the like. Such descriptions are intended to indicate that a selection among many alternatives can be made, and such selections need not be better, smaller, or otherwise preferable to other selections.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Unless otherwise indicated, all numbers expressing quantities of components, angles, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under test conditions/methods familiar to those of ordinary skill in the art. When directly and explicitly distinguishing embodiments from discussed prior art, the embodiment numbers are not approximates unless the word "about" is recited. Furthermore, not all alternatives recited herein are equivalents.

In view of the many possible embodiments to which the principles of the disclosed technology may be applied, it should be recognized that the illustrated embodiments are only preferred examples and should not be taken as limiting the scope of the disclosure. Rather, the scope of the disclosure is at least as broad as the following claims. We therefore claim all that comes within the scope and spirit of these claims.

The invention claimed is:

1. An assembly for conveying sports equipment, comprising:

a first pulley;

a second pulley spaced apart from the first pulley;

a continuous belt extending between the first pulley and the second pulley and movable by rotation of the first pulley and the second pulley;

a plurality of engagement members coupled to and movable with the belt such that the engagement members travel along a path extending from the first pulley to the second pulley and back to the first pulley when the belt is in motion, the engagement members being configured to engage and convey sports equipment along the path; and a stop member located along the path of the engagement members, the stop member comprising an extension portion configured to contact sports equipment conveyed by the engagement members;

wherein the second pulley is spaced apart from the first pulley along a first axis, and the second pulley is spaced apart from the first pulley along a second axis that is perpendicular to the first axis such that the belt is inclined toward the second pulley, and such that sports equipment engaged with an engagement member of the plurality of engagement members beneath the first pulley will advance toward the second pulley; and wherein the extension portion of the stop member is below the second pulley and beneath the path of the engagement members such that when the belt is in motion, empty engagement members of the plurality of engagement members proceed along the path above the extension portion of the stop member, and the extension portion of the stop member is configured to stop motion of the belt upon contacting sports equipment conveyed by an engagement member of the plurality of engagement members.

2. The assembly of claim 1, wherein:

the first pulley, the second pulley, and the belt are at least partially enclosed in a housing; and the engagement members extend out of the housing such that the path of the engagement members extends around an exterior of the housing.

3. The assembly of claim 1, wherein the engagement members are angled relative to the belt such that sports equipment coupled to engagement members beneath the belt hang parallel to the second axis.

4. The assembly of claim 1, wherein each engagement member comprises a support member coupled to the belt at one end, and a pair of clamping members extending from the support member at the other end such that the clamping members are offset from the belt along the second axis.

5. The assembly of claim 4, wherein:

the first pulley is configured to rotate about a first rotation axis;

the second pulley is configured to rotate about a second rotation axis; and the clamping members extend from the support members parallel to the first and second rotation axes.

6. The assembly of claim 5, wherein the clamping members are configured to engage sports equipment to be conveyed along the path such that longitudinal axes of the conveyed sports equipment are oriented perpendicular to the axes of rotation of the first and second pulleys.

7. The assembly of claim 1, further comprising a motor coupled to the first pulley or to the second pulley to drive the belt.

8. The assembly of claim 7, wherein the stop member comprises a limit switch configured to stop operation of the motor when the limit switch contacts sports equipment conveyed by an engagement member of the plurality of engagement members.

9. The assembly of claim 1, further comprising:

a base having a first portion configured to be mounted to a support, and a second portion coupled to the first portion and offset from the first portion;

wherein the first pulley and the second pulley are coupled to the second portion of the base such that at least a portion of the path of the engagement members is offset from the first portion of the base.

10. The assembly of claim 9, wherein the base further comprises a third portion between the first portion and the second portion, the third portion extending outwardly from the first portion such that the second portion is spaced apart from the first portion.

11. The assembly of claim 9, wherein:

the engagement members are configured to engage handles of sports equipment; and the base further comprises a tray configured to receive game balls.

12. The assembly of claim 11, wherein the first and second pulleys are coupled to an opposite side of the second portion of the base from the tray.

13. The assembly of claim 9, wherein the stop member is coupled to the second portion of the base, and the extension portion is oriented perpendicular to the direction of motion of engagement members along the path.

14. An assembly for conveying sports equipment, comprising:

a first pulley configured to rotate about a first rotation axis;

a second pulley spaced apart from the first pulley and configured to rotate about a second rotation axis, the second pulley being spaced apart from the first pulley along a first axis and along a second axis that is perpendicular to the first axis;

a continuous belt extending between the first pulley and the second pulley and inclined downwardly toward the second pulley, the belt being movable by rotation of the first pulley and the second pulley;

a plurality of engagement members coupled to and movable with the belt such that the engagement members travel along a path extending from the first pulley to the second pulley and back to the first pulley when the belt is in motion, the engagement members being configured to engage and convey sports equipment along the path such that longitudinal axes of the conveyed sports equipment are oriented perpendicular to the axes of rotation of the first and second pulleys;

a stop member located along the path of the engagement members, the stop member comprising an extension portion disposed below the second pulley and beneath the path of the engagement members;

wherein the extension portion of the stop member is configured to allow empty engagement members of the plurality of engagement members to proceed along the path above the extension portion of the stop member, and to stop motion of the belt upon contacting sports equipment conveyed by an engagement member of the plurality of engagement members.

15. The assembly of claim 14, wherein:

the first pulley, the second pulley, and the belt are at least partially enclosed in a housing; and the engagement members extend out of the housing such that the path of the engagement members extends around an exterior of the housing.

16. The assembly of claim 14, wherein:

the engagement members are angled relative to the belt such that sports equipment coupled to engagement members of the plurality of engagement members beneath the belt hang parallel to the second axis.

17. The assembly of claim 16, wherein each engagement member comprises a support member coupled to the belt at one end, and a pair of clamping members extending from the support member at the other end such that the clamping members are offset from the belt along the second axis.

18. The assembly of claim 1, further comprising a tray configured to receive game balls, the tray having a first end portion and a second end portion, the tray being inclined such that game balls received in the tray roll toward the second end portion, the second end portion comprising a stop member configured to retain game balls in the tray.

19. The assembly of claim 14, further comprising a tray configured to receive game balls, the tray having a first end portion and a second end portion, the tray being inclined such that game balls received in the tray roll toward the second end portion, the second end portion comprising a stop member configured to retain game balls in the tray.

20. A method comprising coupling an assembly to a support, the assembly comprising a first pulley, a second pulley spaced apart from the first pulley, a continuous belt extending between the first pulley and the second pulley and movable by rotation of the first pulley and the second pulley, a plurality of engagement members coupled to and movable with the belt such that the engagement members travel along a path extending from the first pulley to the second pulley and back to the first pulley when the belt is in motion, the engagement members being configured to engage and convey sports equipment along the path, the assembly further comprising a stop member located along the path of the engagement members, the stop member comprising an extension portion configured to contact sports equipment conveyed by the engagement members, wherein the second pulley is spaced apart from the first pulley along a first axis, and the second pulley is spaced apart from the first pulley along a second axis that is perpendicular to the first axis such that the belt is inclined toward the second pulley, and such that sports equipment engaged with an engagement member of the plurality of engagement members beneath the first pulley will advance toward the second pulley, and wherein the extension portion of the stop member is below the second pulley and beneath the path of the engagement members such that when the belt is in motion, empty engagement members proceed along the path above the extension portion of the stop member, and the extension portion of the stop member is configured to stop motion of the belt upon contacting sports equipment conveyed by an engagement member of the plurality of engagement members.

* * * * *